United States Patent [19]

Kipphan et al.

[11] Patent Number: 5,031,535

[45] Date of Patent: Jul. 16, 1991

[54] METHOD OF DETERMINING PRINTING INK CONSUMPTION IN AN OFFSET PRINTING PRESS

[75] Inventors: Helmut Kipphan, Schwetzingen; Anton Rodi, Leimen; Gerd Laubmann, Wemding, all of Fed. Rep. of Germany

[73] Assignee: Heidelberger Druckmaschinen AG, Heidelberg, Fed. Rep. of Germany

[21] Appl. No.: 420,277

[22] Filed: Oct. 12, 1989

[30] Foreign Application Priority Data

Oct. 15, 1988 [DE] Fed. Rep. of Germany ..... 3835221

[51] Int. Cl.[5] ..... B41M 1/06; B41F 31/14; B41F 33/00

[52] U.S. Cl. ..... 101/483; 101/350; 101/365; 101/DIG. 45

[58] Field of Search ..... 101/350, 349, 351, 352, 101/365, DIG. 32, DIG. 45, DIG. 47, 484, 483, 450.1

[56] References Cited

U.S. PATENT DOCUMENTS 4,200,932 4/1980 Schramm et al. ..... 101/350 X

FOREIGN PATENT DOCUMENTS 1574476 9/1980 United Kingdom .

OTHER PUBLICATIONS

Fed. Rep. of Germany, publication "Heidelberg News", 3/35, 1977, entitled Heidelberg Offset CPC.

*Primary Examiner*—Clifford D. Crowder

*Attorney, Agent, or Firm*—Herbert L. Lerner; Laurence A. Greenberg

[57] ABSTRACT

A method of determining printing-ink consumption in an offset printing press includes feeding printing ink to an inking unit of a printing press via an ink duct having adjustable ink-gap openings, and via an ink-duct roller which absorbs the ink emerging from the ink-gap openings; determining ink-film thicknesses ($s_F$) from the ink-gap openings, and ink-strip length ($l_F$) and ink-strip width ($b_F$) per unit time from the rotational speed of the ink-duct roller, and calculating therewith the quantity of printing ink supplied per unit time of per number of printed products in accordance with the equation $$M_F = K \times s_F \times l_F \times b_F \times f$$

wherein K represents a constant specific to the printing-press and f represents both a function specific to an adjustment of the press and also a function specific to the material, and displaying the determined ink consumption.

11 Claims, 3 Drawing Sheets

METHOD OF DETERMINING PRINTING INK CONSUMPTION IN AN OFFSET PRINTING PRESS

The invention relates to a method of determining printing ink consumption in an offset printing press.

A device for measuring volume of transferred printing ink has become known heretofore from German Patent 36 09 625. This device is formed of a hand-held instrument, which is able to be brought into engagement with a photo-engraved form roller. Ink is transferred from the photo-engraved form roller onto the hand-held instrument by contact between the photo-engraved form roller and a roller disposed on the hand-held instrument. The transferred ink collects in a reservoir or receptacle, which contains a float in order thereby to indicate the fill level of the reservoir.

A marked disadvantage of this prior art device is due to the removal of ink from the photo-engraved form roller. This disrupts the printing process because, after the removal of ink, ink has to be built up again at the point of removal in order to produce a uniform printed image.

A further disadvantage is that such a measurement of the instantaneous quantity of ink on a photo-engraved form roller does not permit any conclusion to be derived with regard to the total ink consumption of a printing job. A continuous measurement cannot be performed; hence, there is no way of detecting any adjustment or variation in the inking and, thereby, any change in the ink film in the course of printing.

In addition, flow rate measuring devices have become known heretofore, which measure the quantity of ink supplied to the printing press. Such flow-rate measuring devices, however, can be used only in cases where there is a relatively high ink consumption, for example in web-fed offset printing presses. Furthermore, such a determination of ink consumption calls for suitable flow-rate measuring and display devices, so that for reasons of cost alone, the use of such devices is not practical.

It is accordingly an object of the invention, therefore, to provide a method of determining the required amount of printing ink without any special additional devices on the printing press and with which it is thus possible to precisely measure the consumption on any offset printing presses economically.

With the foregoing and other objects in view, there is provided, in accordance with the invention, a method of determining printing-ink consumption in an offset printing press, which comprises feeding printing ink to an inking unit of a printing press via an ink duct having adjustable ink-gap openings, and via an ink-duct roller which absorbs the ink emerging from the ink-gap openings; determining ink-film thicknesses ($s_F$) from the ink-gap openings, and ink-strip length ($l_F$) and ink-strip width ($b_F$) per unit time from the rotational speed of the ink-duct roller, and calculating therewith the quantity of printing ink supplied per unit time or per number of printed products in accordance with the equation $$M_F = K \times s_F \times l_F \times b_F \times f$$

wherein K represents a constant specific to the printing-press and f represents both a function specific to an adjustment of the press and also a function specific to the material, and displaying the determined ink consumption.

A marked advantage of the invention is the determination of ink consumption without special measuring devices.

The adjusting or setting systems present on the printing press, both for the inking-gap opening as well as for the ink-duct roller, generate feedback signals Evaluation of these signals can be performed without major effort by a suitable computing device, and the ink consumption, which, based upon a specification or prescribed value of the inking-gap opening and of the ink-strip width per unit time, is determined by the rotational speed of the ink-duct roller, can be indicated continuously.

Both the inking-gap opening and the rotational speed of the ink-duct roller are preset prior to the start of printing.

This presetting is performed based upon previously conducted determination of the size of the ink-carrying areas of a printing plate or based upon stored presetting data. With this setting effected prior to the start of printing, it is thus possible to determine, at a very early point in time the probable ink consumption with reference to a printed sheet or with reference to the entire number of printed sheets. The anticipated quantity of ink can thereby be introduced into the printing press at the, start of printing, with the result that it is no longer necessary during the performance of the printing job to replenish the ink or to check the ink remaining available.

Furthermore, the determination of ink consumption serves to monitor the use of auxiliary substances in the production of a printed product as well as to evaluate and to calculate the total consumption of materials and substances, respectively.

In accordance with another mode of the method invention, which is also used in cases wherein the ink duct has a plurality of ink-metering devices, the inking-gap openings, which differ in accordance with the zonal ink demand, are measured and, from there measured inking-gap openings, the discrete ink-film thicknesses are determined, so that the computation of the ink quantity can be based on an ink-film thickness profile across the entire printing width.

In accordance with a further mode of the method invention, an existing control device, which is provided for the control of the printing press and to which the adjusted inking-gap openings and the ink-strip width are fed back by the printing press, serves for determining the ink consumption. This device is modified so that the quantity of ink consumed is computed from the fed-back data. Such a modification may be effected in a relatively simple manner by introducing the computation algorithm into the control program already present in the control device. Such a control device has become known heretofore, for example, under the name of CPC 1 from Heidelberger Druckmaschinen AG and is described in the company publication "Heidelberger News 3/35", 1977.

The determined ink consumption can also be fed in accordance with an added mode of the inventive method, to an operatingdata registering system, which registers all operating data including the consumption of auxiliary substances or energy, for producing the printed product, and permits the calculation of the operating costs. Likewise, the ink consumption can be printed out via a printer and/or can be displayed e.g. on a monitor. Thus, the method of the invention includes feeding the determined consumption of printing ink to at least one of an operating-data register system and a protocol printer.

In accordance with an additional mode of the method according to the invention, for the purpose of monitoring the amount of ink in the ink duct, it is also possible to compare the quantity of printing ink applied to the ink duct with the calculated ink-consumption value and, if there is any risk that the ink duct may run dry, to generate a warning signal. This warning signal may inform the operator both visually as well as audibly.

In accordance with yet another mode of the method according to the invention, if the printed product is monitored by means of a control strip which is additionally printed on the printed product in order to determine the ink-density value, then the transfer of ink to the printed product can be calculated from the densitometrically determined ink-density value of the ink on the printed product If the calculated density value deviates from a setpoint density, then a correction factor is determined from this deviation and this is taken into account in the calculation of the consumption. The transmission of the densitometrically measured data of the control strip to the control apparatus is accomplished via data lines. Such a densitometric measuring device is likewise described in the aforementioned issue of the Heidelberg publication.

Further correction factors preferably take into account the influence of temperature and/or viscosity of the printing ink. Furthermore, the type of paper used i.e. highly absorbent paper or very smooth paper, for example, plays a role in the consumption of printing ink. This also is taken into account by a suitable correction factor, in accordance with the method of the invention.

It is possible, from the proportionate area of a printing plate covered by a printed image, to make a rough calculation of the probable ink consumption. This calculation, too, serves as basis for a provisional ink-consumption value or a correction factor, in accordance with yet a further mode of the method according to the invention.

In accordance with a concomitant mode of the method invention consumption of all printing inks is determined. The consumption of all of the printing inks in a multicolor printing press is displayed as well as separately for each individual color. In addition, the consumption can be outputted in a form normalized to a given number of printed products.

Other features which are considered as characteristic for the invention are set forth in the appended claims.

Although the invention is illustrated and described herein as embodied in a method of determining printing ink consumption in an offset printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
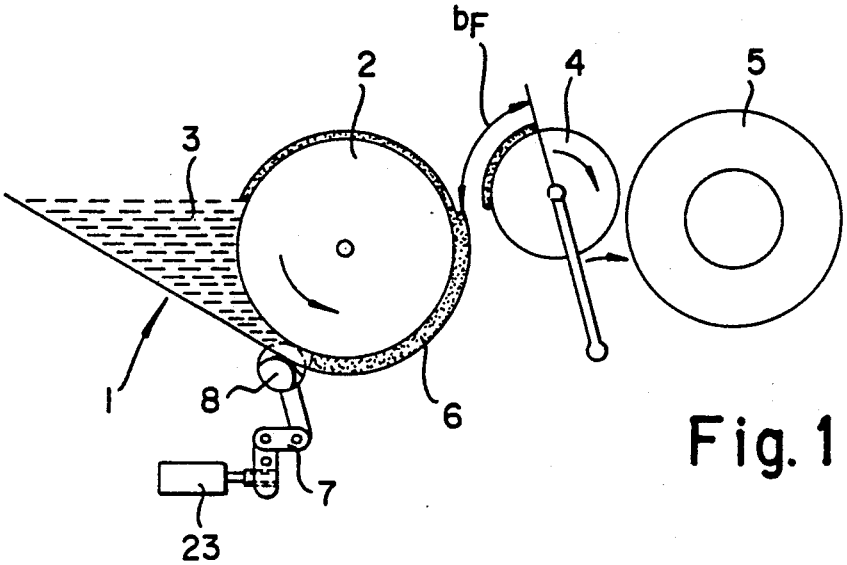
FIG. 1 is a diagrammatic side elevational view of an ink duct of an offset printing press.

Referring now to the drawing and, first, particularly to FIG. 1 thereof, there is shown therein an ink duct 1 operatively associated in a conventional manner with an ink-duct roller 2, between which the ink 3 is poured into in a wedge-shaped space. This ink is fed in a thin ink film 6 by the ink-duct roller 2 via a vibrator or lifter roller 4 to a first inking-unit roller 5, from which it is transferred to an otherwise non-illustrated inking unit. The ink film 6, which is transferred in part from the ink-duct roller 2 onto the vibrator 4, has a film thickness $s_F$ (FIG. 2) which is matchable via an ink-metering device to the respective requirements i.e. to the respective subject being printed. The length of the ink duct 1 and of the rollers is designed to suit the maximum possible printing size. In a conventional manner, the ink duct 1 and the rollers are mounted to the sides thereof in non-illustrated printing-unit side walls. The ink-metering device 7 is made up of zone-width metering elements 8, which are disposed closely adjacent one another along the length of the ink duct roller 2 and extend over the width of the ink duct 1. Each metering element 8 is adjusted with respect to the desired ink-film thickness by a drive 23, which is coupled to a position detector. Further details regarding the construction of such ink-metering devices are contained in British Patent 1 574 476, for example.

While the vibrator 4 is in contact with the ink-duct roller 2, part of the ink film 6 is transferred onto the vibrator 4 due to so-called splitting of the ink. The length of time during which the vibrator 4 is in contact with the ink-duct roller 2, and the rotational speed of the ink-duct roller 2 determine ink-strip width $b_F$ of the ink film which is transferred. Ink-strip length $l_F$ (FIG. 2) and the ink-film thickness $s_F$ are defined by the ink-metering apparatus 7.

Figure 2:
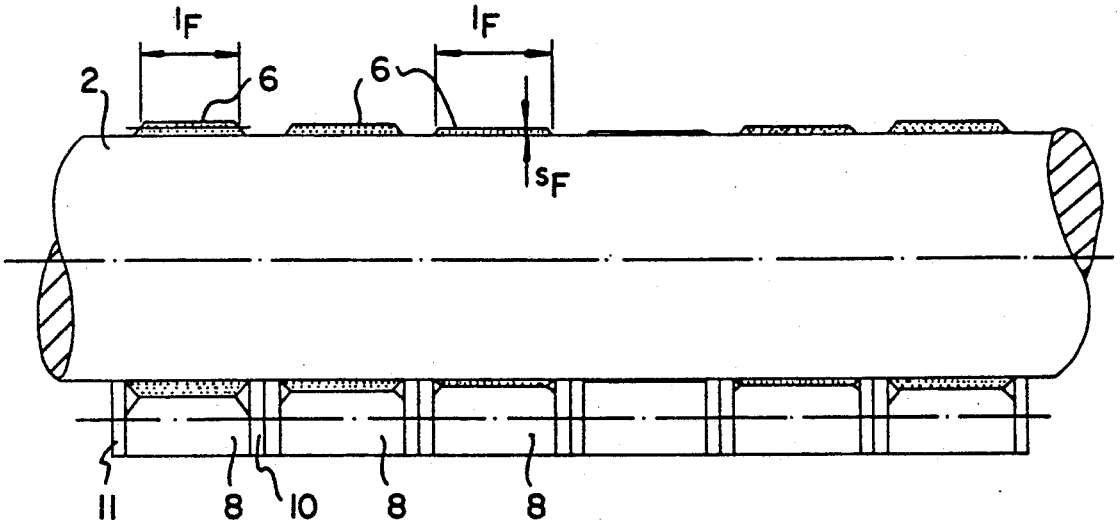
FIG. 2 is a view of ah ink profile as applied to an ink-duct roller.

FIG. 2 shows, in a longitudinal sectional view, an ink profile that has been applied to the ink-duct roller 2, the aforementioned ink-film thickness sF and ink-strip length $l_F$ being clearly indicated therein. The metering elements 8 are in contact with the ink-duct roller 2 over the respective support areas thereof. Depending upon the position or setting of the metering elements 8, an ink film $s_F$ having a greater or lesser thickness is transferred from the ink duct 1 onto the ink-duct roller 2. The ink-strip length $l_F$ for each metering element is virtually constant. From the number of individual metering elements, it is thus possible to determine the total ink-strip length $L_F$. The values for the ink-strip width $b_F$, the ink-film thickness $s_F$ and the ink-strip length $l_F$ are used to determine the ink for each inking zone which is transferred onto the vibrator 4 within one cycle of the vibrator 4. The settings of the individual metering elements 8 and, accordingly, the data required for determining the ink consumption are set or adjusted on the control desk of the printing press and are fed back by the printing press. Likewise, the ink-strip width i.e. the time during which the vibrator 4 is in contact with the ink-duct roller 2, is set via the control desk; thus, this value is likewise available at the control desk. Because all data required for calculating the ink consumption are thus available at the control desk, it is possible for the method of determining the ink consumption to be performed in a relatively simple manner by a computer at the control desk. The construction of the printing unit influences this calculation, because the number of rollers and the arrangement of the rollers decisively determine the ink distribution until the ink is applied to the printing plate. Such a control desk for the operation of the printing press base become known heretofore, for example, from the "Heidelberg News", as mentioned hereinbefore.

Figure 3:
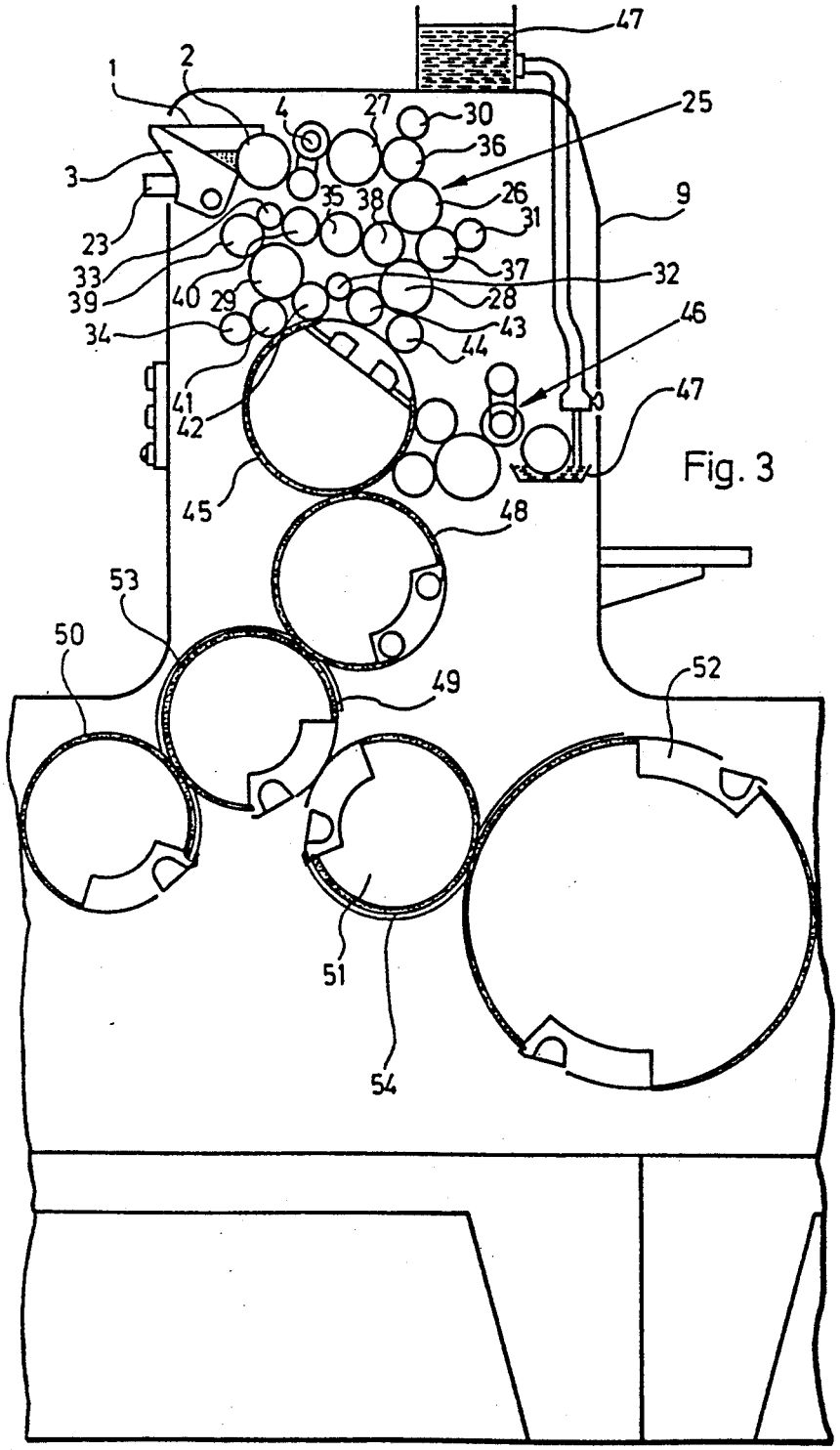
FIG. 3 is a diagrammatic side elevational view of an offset printing unit for inking a printing plate and for transferring a printed image onto a sheet.

FIG. 3 illustrates an offset printing unit. The entire inking process is apparent from this figure, starting from the ink duct 1 and extending as far as the application of the ink onto a printed sheet 53. The ink duct 1, the ink-duct roller 2 and the vibrator 4 are as shown in FIG. 1 and need not be described in any greater detail. The inking unit 25 contains distributors 26 to 29, rider rollers 30 to 34, a transfer roller 35, rubber-covered rollers 36 to 40 and form rollers 41 to 44. The ink 3, which is transferred via the vibrator 4 to the inking unit 25, splits into approximately two equal ink-film thicknesses each time two rollers strike one another. In addition to the transfer of ink, there is a distribution of the ink on the surface of the roller, which depends upon the type and function of the roller. Besides having an important effect upon the uniform inking of the printing plate, the number and circumference of the form rollers also have an influence on the quantity of printing ink which is finally applied to the printing plate. The specific arrangement of the rollers in the inking unit 25 produces a precisely defined application of ink onto the printing plate via the form rollers 41 to 44. Each of the four form rollers applies a specific quantity of ink to the printing plate. The printing plate is provided with dampening solution via a dampening unit 46. This dampening solution is supplied to the dampening unit 46 via a dampening-solution reservoir 47.

The ink applied to the printing plate is transferred via a rubber-blanket cylinder 48 onto a sheet carried by the impression cylinder 49. Ink splitting takes place likewise both between plate cylinder 45 and rubber-covered cylinder 48 as well as between the rubber-covered cylinder 48 and the printed sheet 53. If the entire course of the ink flow, starting from the ink duct 1 and up to the application of the ink onto the printed sheet, is then considered, it can be determined that only a fraction of the ink-film thickness applied to the ink-duct roller 2 is transferred to the printed sheet. The determination of this ratio between the two ink-film thicknesses is, nevertheless, possible based upon the structure of the inking unit, taking into consideration the number of ink splittings between the rollers. This ratio essentially determines the constant K specific to the printing press. The factor K, may also be determined empirically, however, for example by means of a test run. The sheet-transport cylinders 50 to 52 transport the printed sheets 53 and 54 through the individual printing units of the printing press.

Figure 4:
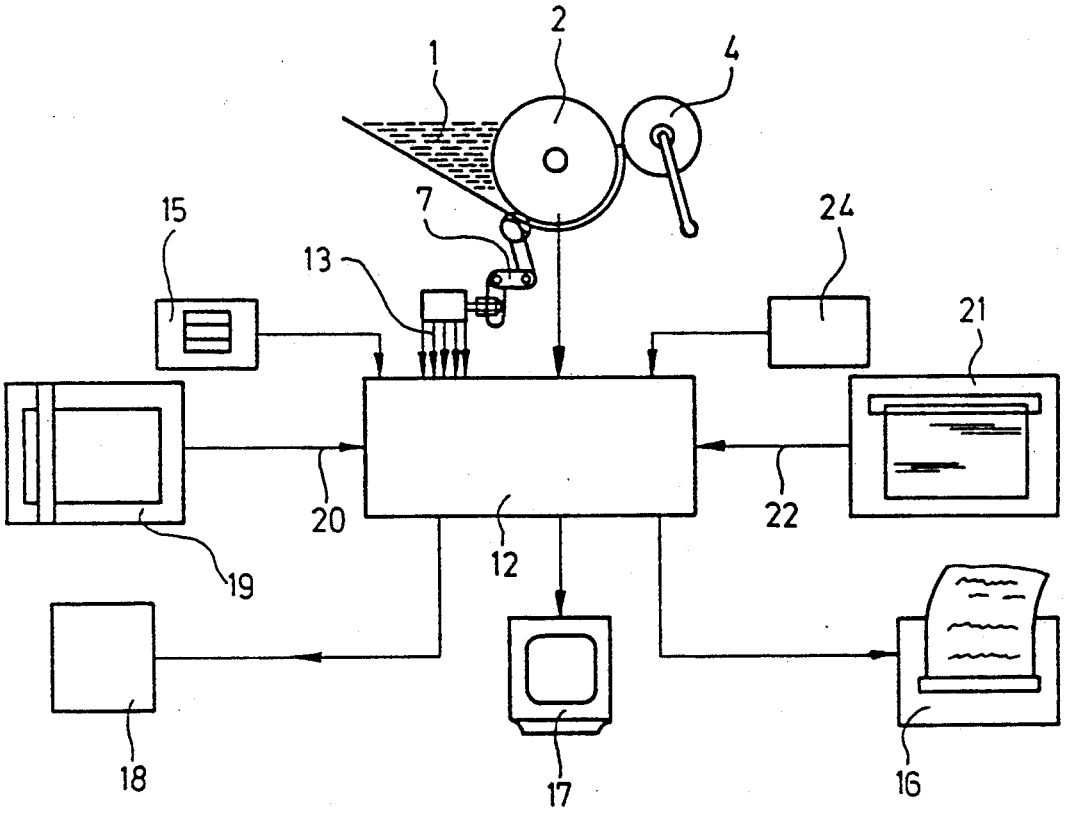
FIG. 4 is a diagrammatic and schematic representation of an apparatus for determining ink consumption.

FIG. 4 shows, in a diagrammatic and schematic representation, a device for determining ink consumption, the essential elements thereof being already contained in the control desk. The data necessary for determining the ink consumption is fed to a central processing unit 12. The data are the positions of the individual ink-metering devices 7, the adjusting signals of which are reported via the lines 13. In addition, the rotational speed of the ink-duct roller 2 is reported to the processing unit 12 via the line 14. Further data, such as the temperature or the viscosity of the ink, are additionally reported to the processing unit 12 via sensors 24 for additional variables. Moreover, a data-input/command-input keyboard 15 is provided, with which data, such as the number of printed products to be produced or the type of paper to be printed, are inputted.

Based upon the basis of the inputted data, the processing unit 12 determines the quantity of printing ink consumed for each inking zone in accordance with the equation $$M_F = K \times s_F \times l_F \times b_F \times f.$$

The total quantity $M_F$ is then calculated by adding up the total inking-zone values.

$S_F$ is the ink-film thickness formed by the inking-gap opening of each metering element. $l_F$ is the ink-strip length which is constant for all zones, as is the ink-strip width $b_F$, which is determined from the rotational speed of the ink-duct roller 2. The factor K represents a constant specific to the printing press, which, as mentioned hereinbefore, takes into account both the ink-splitting ratio in the inking unit and also further correction values specific to the printing press. The factor f is a function containing further influences specific to the material and/or specific to the setting or adjustment.

This factor f can be determined both by an analysis of the effect of the influencing factors on the flow of ink and by arithmetical modelling as well as by an empirical determination under specific printing conditions i.e. at given ink temperatures, with given types of paper, at given ambient temperatures, and the like.

The determined quantity of printing ink may be both based upon the printed product i.e. for a specific number of prints and based upon a printing job, respectively. The determination of the quantity of ink based upon the printing job represents, in fact, an important variable for the calculation of printing costs and also for the monitoring of total ink consumption. The determined ink consumption can be printed out via a data printer 16 or can be indicated via a display 17. It is also possible to store the ink consumption (memory 18). This memory device is, for example, a diskette on which all data of relevance for printing i.e. settings and further consumption values, for example, are stored, these data being required in repeat printing jobs for resetting the printing press and for predetermining the anticipated ink demand.

In many cases, a so-called printing-plate reader 19 is used for presetting the ink-metering devices 7 on a printing press. With this printing-plate reader, the printing plate is scanned and the proportion of printing to non-printing areas is registered for each zone. In the determination of ink consumption, the data from the printing-plate reader can be used for a first approximation of the probable ink consumption and, after the calculation of the actual ink consumption, an adjustment can be made between this approximate value and the calculated ink-consumption value. For this purpose, the data determined by the printing-plate reader 19 are transferred via the line 20 to the processing unit 12.

The quality of the printed product is frequently monitored by a densitometric evaluation of a measuring strip that is also printed on the printed product. At a measuring desk 21, the measuring strip is evaluated and the ink density of the individual colors is determined zonally. A conclusion can then be drawn from this measurement of the ink density with regard to the ink-film thickness.

The ink-density values are therefore transmitted likewise to the processing unit 12 via the line 22, it then being possible for these values likewise to represent a correction factor for optimizing the accuracy of the arithmetically determined consumption.

If an inking unit is used in which there is no vibrator (film-type inking unit), then the ink-strip width per printed product can be determined from the rotational speed ratios of the impression cylinders, of the ink-duct roller and of the ink-transfer roller.

Because the ink consumption is calculated continuously, it is possible at all times to indicate or display the instantaneous ink consumption, the total actual ink consumption and also the probable total ink consumption, having taken into account the number of printed products to be produced.

The foregoing is a description corresponding in substance to German Application P 38 35 221.4, dated Oct. 15, 1988, the International priority of which is being claimed for the instant application, and which is hereby made part of this application. Any material discrepancies between the foregoing specification and the aforementioned corresponding German application are to be resolved in favor of the latter.

There is claimed:

1. Method of determining printing-ink consumption in an offset printing press, which comprises feeding printing ink to an inking unit of a printing press via an ink duct having adjustable ink-gap openings, and via an ink-duct roller which absorbs the ink emerging from the ink-gap openings; determining ink-film thicknesses ($s_F$) from the ink-gap openings, and ink-strip length ($l_F$) and ink-strip width ($b_F$) per unit time from the rotational speed of the ink-duct roller, calculating therewith the quantity of printing ink supplied per unit time or per number of printed products in accordance with the equation $$M_F = K \times s_F \times l_F \times b_F \times f$$

wherein K represents a constant based upon a ratio of ink-film thicknesses on a plate cylinder and a rubber-covered cylinder of the printing press specific to the printing-press and f represents a function containing factors influencing ink flow specific to an adjustment of the press and specific to material being printed on, displaying the determined ink consumption and, in accordance with the determined ink consumption, introducing at the start of a printing job a quantity of ink obviating any necessity for checking and replenishing the ink during the performance of the printing job.

2. Method according to claim 1, which includes determining the ink-gap openings with ink-metering devices.

3. Method according to claim 1, which includes feeding-back the data regarding the ink-gap openings and the ink-strip width set in the printing press to a control device in the printing press, calculating with the control device the consumption of printing ink from the fed-back data.

4. Method according to claim 1, which includes feeding the determined consumption of printing ink to at least one of an operating-data registering system and a protocol printer.

5. Method according to claim 1, which includes comparing, during the printing operation, the consumed quantity of printing ink with the quantity of printing ink applied to the ink duct prior to the start of printing and generating a warning signal and/or triggering a control intervention in the printing press when the quantity falls below a residual value.

6. Method according to claim 1, which includes determining an ink-density value from a printed product by means of an ink-density measuring device, and determining from the ink-density value a correction for an ink consumption measurement.

7. Method according to claim 1, which includes forming a correction factor from at least one of the temperature and viscosity of the printing ink and the type of paper to be printed.

8. Method according to claim 1 which includes determining the proportionate area of a printing plate covered by a printed image, and forming therewith and with a determination of the number of printed products to be produced a first approximate value for the consumption of printing ink.

9. Method according to claim 8, which includes determining an ink-density value from a printed product by means of an ink-density measuring device and deriving the ink-film thickness from the ink-density value, and determining the quantity of ink applied to the printed sheet from the image-area proportion and from the ink-film thickness.

10. Method according to claim 9, which includes at least one of determining and correcting with the calculated ink quantity, the function f specific to both an adjustment of the printing press and to the material.

11. Method according to claim 1, which includes displaying the consumption of at least one printing ink in relation to at least one of ink volume and the ink quantity for a given number of printed products.

* * * * *